US006404130B1

(12) United States Patent
Dinter

(10) Patent No.: US 6,404,130 B1
(45) Date of Patent: Jun. 11, 2002

(54) METAL HALIDE LAMP WITH FILL-EFFICIENT TWO-PART LEAD-THROUGH

(75) Inventor: Reiner-Joachim Dinter, Munich (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/498,952

(22) Filed: Feb. 4, 2000

(30) Foreign Application Priority Data

Feb. 26, 1999 (DE) ..... 199 08 688

(51) Int. Cl.[7] ..... H01J 17/26

(52) U.S. Cl. ..... 313/630; 313/311; 313/346 R; 313/631; 313/632

(58) Field of Search ..... 313/623, 624, 313/625, 626, 630, 632, 311, 318.07, 318.08, 318.09, 331, 332, 333, 335, 346, 348, 334, 346 R, 353

(56) References Cited

U.S. PATENT DOCUMENTS 4,122,042 A 10/1978 Anna et al. ..... 252/513
4,155,757 A 5/1979 Hing ..... 75/232
4,155,758 A 5/1979 Evans et al. ..... 75/232
4,354,964 A 10/1982 Hing et al. ..... 252/518
4,501,799 A 2/1985 Driessen et al. ..... 428/469
4,585,972 A 4/1986 Hing ..... 313/636

FOREIGN PATENT DOCUMENTS

EP 0587238 3/1994 ..... H01J/61/36

*Primary Examiner*—Sandra O'Shea
*Assistant Examiner*—Ismael Negron
(74) *Attorney, Agent, or Firm*—William H. McNeil

(57) ABSTRACT

The metal halide lamp with a ceramic discharge vessel (4) has sealing means at its two ends (6), an electrically conductive lead-through (9, 10; 30) being guided through these means in a vacuum-tight manner, to which lead-through an electrode (14) with a shank (15) is attached, which electrode projects into the interior of the discharge vessel. At least a front part, which faces toward the discharge, is designed as a component made from electrically conductive cermet which comprises a halide-resistant metallic phase and a ceramic phase of a ceramic base material. The fill comprises at least one halide of a rare-earth metal. At least on the front side of the component, at least part of the ceramic phase comprises the combination of the ceramic base material and one or more rare-earth metal oxides.

12 Claims, 3 Drawing Sheets

METAL HALIDE LAMP WITH FILL-EFFICIENT TWO-PART LEAD-THROUGH

TECHNICAL FIELD

The invention is based on a metal halide lamp with a ceramic discharge vessel according to the preamble of claim 1. It relates in particular to metal halide lamps with an output of at least 100 W.

PRIOR ART

EP-A-587,238 has already disclosed a metal halide lamp with a ceramic discharge vessel and halide-resistant lead-through of the generic type. The front part of the lead-through, facing toward the discharge, may comprise an electrically conductive cermet (with a ceramic phase and a conductive phase). The ceramic phase is aluminum oxide or MgO, $Sc_2O_3$ or $Y_2O_3$. The conductive phase which is proposed for the cermet is a halogen-resistant metal, for example tungsten, or molybdenum disilicide ($MoSi_2$). In these lamps, it is customary to use fill constituents comprising halides of the rare-earth metals (RE). $DyI_3$ is recommended in this document. As an alternative, it is recommended to use the iodides of Sc, Y, Ho or Tm.

EP-A-887,839 recommends that a continuous cermet pin be used as a lead-through for metal halide lamps with a ceramic discharge vessel.

The drawback of these designs is that a large proportion of the ions of the rare-earth metals which are formed in the fill become bonded through reacting with the ceramic, usually aluminum oxide, even after a short operating period. Therefore, it has hitherto been necessary to use a considerable excess, but this is somewhat undesirable in view of the corrosive properties. Alternatively, if a smaller amount was used, it was necessary to accept that considerable limits were imposed with regard to the maintenance and service life of the lamp by effects such as color drift and an increase in the operating voltage.

DESCRIPTION OF THE INVENTION

The object of the present invention is to provide a metal halide lamp with a ceramic discharge vessel according to the preamble of claim 1 with an improved service life.

This object is achieved by means of the characterizing features of claim 1. Particularly advantageous configurations are given in the dependent claims.

The starting point for the present invention is the discovery that owing to the high temperature in the area of the end face of the lead-through, the rare-earth metal ions from the fill are preferably bonded in the area of a front zone of the lead-through, or at least the surface of that part of the lead-through which is in contact with the discharge volume. This predominantly means the front discharge-side end of the lead-through, since this is where the highest temperature is reached in operation. By contrast, the discharge vessel itself and the sealing means (usually a stopper) are affected to a considerably lesser extent.

Therefore, it may under certain circumstances be sensible to separate the lead-through into a front, particularly halide-resistant part and a rear part which is less at risk. The front part is a cermet component with a ceramic phase and an electrically conductive phase.

Precise investigations have shown that the reaction of the rare-earth metal ions with the ceramic phase of the cermet component results, predominantly in that part of the cermet which is close to the electrodes, in a combination with a chemical composition which, if the ceramic used is aluminum oxide, approximately corresponds to a garnet ($RE_3Al_5O_{12}$) or perovskite ($REAlO_3$) or a mixture of the two. The same applies to other ceramics. If this chemically stable composition is reached after a short operating time, it no longer changes during further operation or service life.

If the ceramic phase of the cermet component, whether it be the entire component or a zone on the surface which faces toward the discharge, now contains a considerable proportion (preferably at least 40, in particular more than 80 mol %) of a corresponding combination formed from the ceramic base material and at least one rare-earth metal oxide, the cermet component or its zone which is exposed to the discharge can no longer bind any rare-earth metal from the fill. Therefore, the fill, and consequently the maintenance, of the lamp are stable for a prolonged service life without having to use an excessive quantity of fill. The surface having a garnet or perovskite structure may be located on the front side and, if appropriate, also on the lateral surface of the cermet component.

Specifically, the invention relates to a metal halide lamp with a ceramic discharge vessel in which the discharge vessel has two ends which are closed off by sealing means. One electrically conductive lead-through is guided in a vacuum-tight manner through each of these means, to which lead-throughs an electrode with a shank is attached, which electrode projects into the interior of the discharge vessel. At least a front part of the lead-through, which faces toward the discharge, is designed as a halide-resistant component made from electrically conductive cermet which comprises an electrically conductive (preferably metallic) phase and a ceramic phase, which comprises a ceramic base material. The fill comprises at least one rare-earth metal (i.e. Sc, Y, La and the 14 lanthanides), usually as a halide or as a complex, or alternatively in elemental form. At least on the end face (front side) of the component, at least part of the ceramic phase comprises the combination of the ceramic base material with one or more rare-earth metal oxides.

The cermet component is preferably a pin or a tube. The electrically conductive phase of the cermet is usually a metal, such as molybdenum or tungsten or rhenium or their alloys, or a metal silicide, such as $MoSi_2$.

The most reliable solution, if also the most expensive, is if at least part of the ceramic phase comprises the combination of the ceramic base material with one or more rare-earth metal oxides over the entire length of the component. Preferably, the entire ceramic phase comprises the combination of the ceramic base material and one or more rare-earth metal oxides. The cermet component may form the front part of the lead-through or the entire lead-through.

The ceramic base material is usually polycrystalline aluminum oxide.

In a first embodiment, the rare-earth metal oxides which are used for the cermet component comprise the oxides of one or more or even all of the rare-earth metals which are contained in the fill.

In a second embodiment, the rare-earth metal oxides comprise the oxides of one or more rare-earth metals which are not contained in the fill, in particular $Y_2O_3$.

In a third embodiment, a mixture of the first two embodiments is used. In a particularly preferred embodiment, the combination of the ceramic base material with one or more rare-earth metal oxides corresponds to a garnet or perovskite or a mixture of the two. Oxides of La, Nd, Sm, Eu or Gd are preferably used as the perovskite. Oxides of Lu, Yb, Tm and Y are preferably used as the garnet. The remaining rare-earth metal oxides are particularly suitable for both structures and their mixtures.

It is particularly simple and effective for the rare-earth metal oxide used to be predominantly or exclusively an oxide of a rare-earth metal with the smallest possible ionic radius, since it appears that the ions of these rare-earth metals diffuse preferentially into the ceramic phase of the cermet component. In particular, it is sufficient to use a single rare-earth metal oxide with an ionic radius which is less than or equal to the ionic radius of that rare-earth metal ion in the fill which has the smallest ionic radius. An effective ionic radius of up to at most about 0.091 nm is recommended. The scandium ion ($Sc^{3+}$) is particularly suitable, with a coordination number of 6. This embodiment has the advantage of being independent of the particular choice of fill, so that it can be used for a number of types in common.

It is possible to use this special cermet component for all metal halide lamps with a ceramic discharge vessel, irrespective of whether the sealing is brought about by means of fusible ceramic or by direct sintering.

The special cermet may in principle be produced in a manner known per se by processing a corresponding powder mixture. The fundamental suitability of such materials (in particular yttrium-aluminum garnet) for lamp production is already known, cf. U.S. Pat. No. 5,698,948. However, in that document, the material is used for discharge vessels. By contrast, the requirement for translucency plays no role in the case of lead-throughs.

The sealing means (usually a stopper) advantageously comprises ceramic or cermet (for example suitably doped aluminum oxide), in which case the ceramic base material of the cermet component corresponds to a principal ceramic constituent of the sealing means, in this case, therefore, aluminum oxide. This arrangement has the advantage that the coefficients of thermal expansion of the two parts are similar, so that the cermet component is particularly easy to sinter directly into the stopper.

FIGURES

The invention is to be explained in more detail below with reference to a plurality of exemplary embodiments. In the drawing:

FIG. 1 shows a metal halide lamp, in section

FIG. 2 shows the proportion of various rare-earth metals in the cermet pin

FIG. 3 shows the discharge vessel of a metal halide lamp, in section

FIG. 4 shows a further exemplary embodiment of a cermet pin

FIG. 5 shows yet another exemplary embodiment of a cermet pin

FIG. 6 shows a further exemplary embodiment of a discharge vessel, in section.

Figure 1:
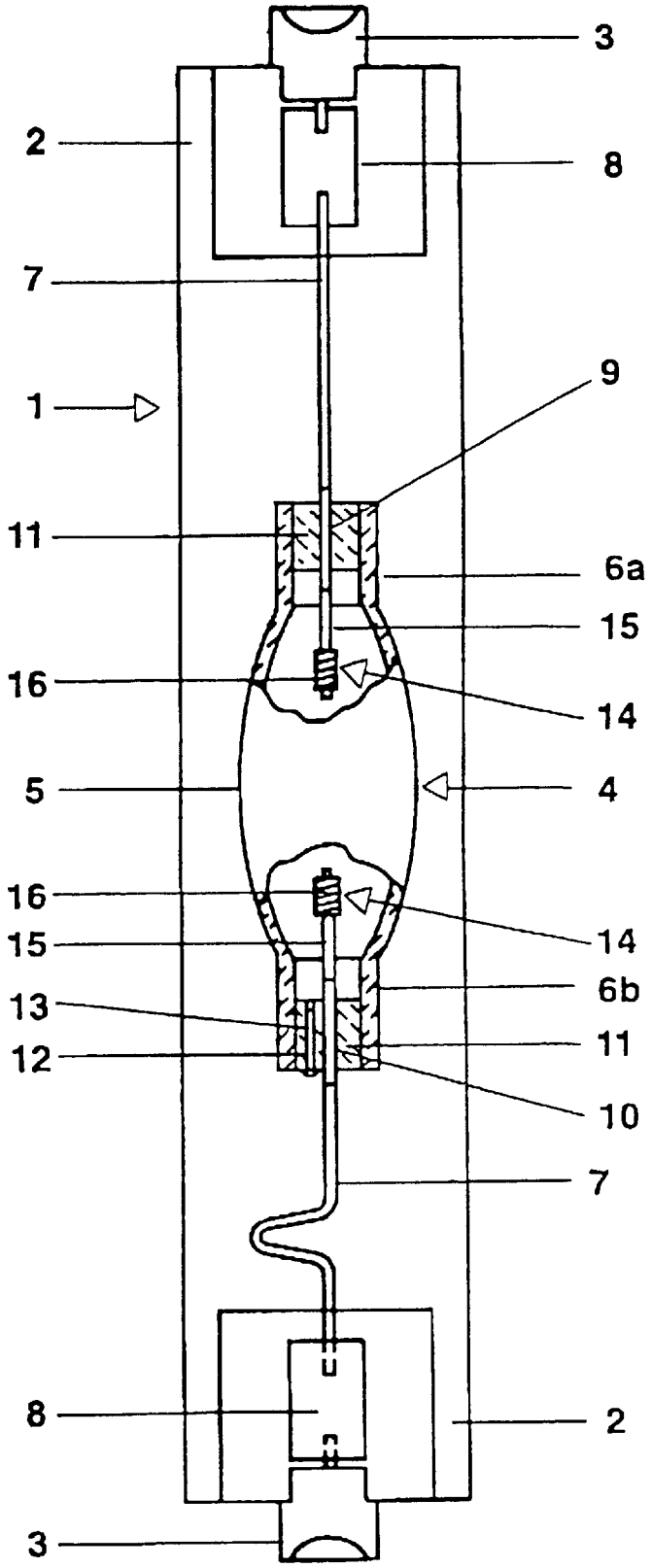
FIG. 1 diagrammatically depicts a metal halide lamp with an output of 250 W. It comprises a cylindrical outer bulb 1 which defines a lamp axis, is made from quartz glass and is pinched at 2 and has cap parts 3 on two sides. The axially arranged discharge vessel 4 made from $Al_2O_3$ ceramic bulges out in the center 5 and has two cylindrical ends 6*a* and 6*b*. It is held in the outer bulb 1 by means of two supply conductors 7, which are connected to the cap parts 3 via foils 8. The supply conductors 7 are welded to lead-throughs 9, 10 which are each fitted in an end stopper 11 at the end of the discharge vessel.

The lead-throughs 9, 10 are cermet pins with a diameter of approx. 1 mm, which are made from an electrically conductive cermet.

Both lead-throughs 9, 10 extend over the entire length of the stopper 11 and, on the discharge side, hold electrodes 14 comprising an electrode shank 15 made from tungsten and a filament 16 which is pushed on at the discharge-side end. Each lead-through 9, 10 is butt-welded to the electrode shank 15 and to the supply conductor 7.

The fill of the discharge lamp comprises, in addition to an inert firing gas, e.g. argon, and possibly mercury, additions of halides of metals, at least one of which is a rare-earth metal.

End stoppers 11 which substantially comprise $Al_2O_3$, for example, are used as the sealing means. It is also possible to use a nonconductive cermet containing as its principal component $Al_2O_3$, in which the metallic component is tungsten, forming approx. 30% by weight (or alternatively molybdenum, forming a correspondingly higher percentage).

Each of the lead-throughs 9, 10 is sintered directly into the stopper 11. In a similar way, each stopper 11 is also sintered directly (i.e. without soldering glass or fusible ceramic) into the cylindrical ends 6*a* and 6*b* of the discharge vessel.

Moreover, an axially parallel hole 12, which is used to evacuate and fill the discharge vessel in a manner known per se, is provided in the stopper 11 at the second end 6*b*. After the discharge vessel has been filled, this hole 12 is closed by means of a pin 13 or by means of fusible ceramic. The pin usually comprises ceramic or cermet.

By way of example, a suitable lead-through 9, 10 is a cermet pin which, in addition to the ceramic phase with the base material aluminum oxide, also contains at least 44 vol % metal (preferably between 45 and 75 vol %) and is electrically conductive. 70 to 90% by weight of tungsten or 55 to 80% by weight of molybdenum (or an amount of rhenium which is equivalent in terms of volume) is particularly suitable. The ceramic phase consists entirely of garnet (see below).

A suitable material for the end stopper is a cermet which contains a smaller amount of metal than the lead-through (preferably about half the amount contained in the lead-through). In this context, the essential property of the stopper is that its coefficient of thermal expansion should lie between that of the lead-through and that of the discharge vessel. However, the metal content of the stopper may also be zero.

The electrode is welded onto the end face of the lead-through before the lead-through is sintered into the stopper. The weldable cermet pin has already been substantially presintered prior to final sintering into the stopper.

By means of the metal halide in the fill, a neutral-white luminous color (NDL) is achieved (color temperature approx. 4300 K) through the interaction of the following constituents (in % by weight):

9.0% TlI; 32.5% NaI; 19.5% of each of the rare-earth metal iodides $Dy_2I_3$, $Ho_2I_3$ and $Tm_2I_3$.

Accordingly, the proportion of the rare-earth metal ions (in % by weight) in the fill was initially:

$Dy^{3+}$5.8% and $Ho^{3+}$5.9% and $Tm^{3+}$6.0%.

A comparison was carried out between lamps of identical design with cermet pins of different compositions; in the control group, a conventional cermet pin was used (containing only aluminum oxide as ceramic phase). The cermet pins according to the invention additionally used rare-earth metal oxides.

During operation, reaction with the fill resulted, in that part of the conventional cermet pin which is close to the electrodes, in a stable structure corresponding to the chemical combination of 62.5 mol % (30.9% by weight) aluminum oxide, 9.6 mol % (17.4% by weight) dysprosium oxide, 11.5 mol % (21.1% by weight) holmium oxide and 16.4 mol % (30.6% by weight) thulium oxide, corresponding to a garnet of the chemical formula $0.77\ Dy_2O_3 \cdot 0.92Ho_2O_3 \cdot 1.31Tm_2O_3 \cdot 5\ Al_2O_3$.

In total, 22% of the Dy, 27% of the Ho and 38% of the Tm were removed from the fill and incorporated in the cermet.

Figure 2:
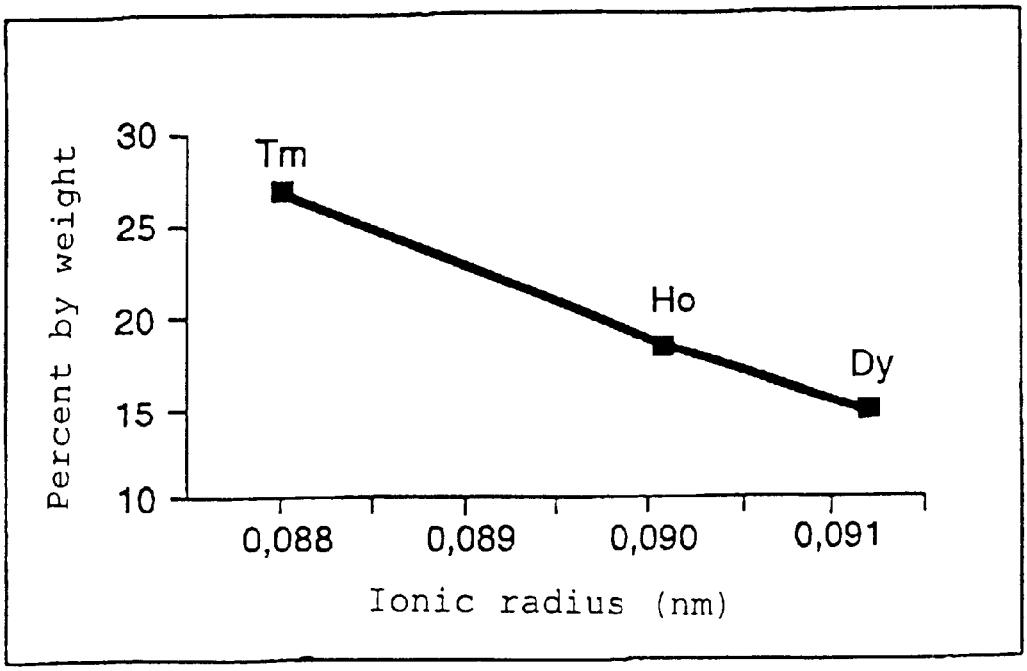

The reacted ceramic of the conventional cermet component contained considerably more of the rare-earth metal ion with the smallest effective ionic radius, i.e. Tm (ionic radius approximately 0.088 nm, cf. in this respect FIG. 2) than of the other two rare-earth metal ions:

$Dy^{3+}$15.2% by weight; $Ho^{3+}$18.4% by weight and $Tm^{3+}$ 26.8% by weight.

While the fill contains approximately equal concentrations of the three rare-earth metals, 22% more Ho and 77% more Tm than Dy diffuse into the cermet component, apparently due to the different ionic radii. It is quite astonishing that such slight differences in the ionic radius can have such drastic consequences.

In a first exemplary embodiment of the invention, the cermet component used has from the outset as its ceramic phase approximately the equilibrium distribution which is naturally established, so that this diffusion process is anticipated:

31% by weight aluminum oxide; 15% by weight dysprosium oxide, 20% by weight holmium oxide and 34% by weight thulium oxide.

In a second exemplary embodiment, the ceramic phase used for this cermet component was a standard garnet using only $Tm_2O_3$ as the rare-earth metal oxide, with aluminum oxide as the base material.

The results were approximately equivalent. It was possible to increase the effective service lives of both exemplary embodiments by more than a factor of 1.5 compared to the control group. As expected, the first exemplary embodiment was about 10% better than the second (since small amounts of the other rare-earth metal ions still diffuse into the cermet), but this relatively minor improvement is not always justified, owing to the considerably increased costs.

In a third exemplary embodiment, the rare-earth metal oxide used is $Sc_2O_3$ (or alternatively $Yb_2O_3$). Both of these ions have a smaller ionic radius (0.075 and 0.087 nm, respectively) than the rare-earth metal ions used in the fill. The resultant service life approximately corresponds to that of the second exemplary embodiment.

Figure 3:
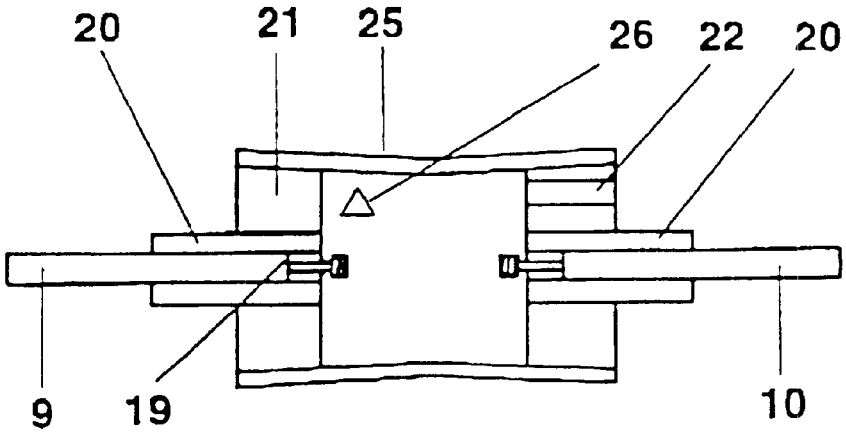

In a second embodiment (FIG. 3), a nonconductive stopper 26 is sintered directly into each of the ends of the approximately cylindrical discharge vessel 25. The lead-throughs 9 and 10 are electrically conductive cermet pins containing 50% by volume metal. The remainder is a ceramic phase. The stopper 26 made from aluminum oxide comprises two concentric parts, namely an outer, annular stopper part 21 and an inner capillary tube 20, which is approximately twice as long. Nevertheless, the capillary tube is approximately 50% shorter than in known capillary-tube techniques. The greater structural length of the capillary tube compared to the stopper parts 21 improves the sealing performance. The lead-through 9 is recessed into the capillary tube 20 and sintered directly into the latter. The filling hole 22 is accommodated in the outer stopper part 21.

Since the cermet pin is recessed inside the capillary tube, an $Eu_2O_3$ perovskite structure is used as ceramic phase only over an axial length of about 1 mm at its end face 19, and this perovskite ceramic phase gradually merges, in a following transition zone, into the known structure with a pure aluminum oxide phase, which is used at the end of the pin.

Figure 4:
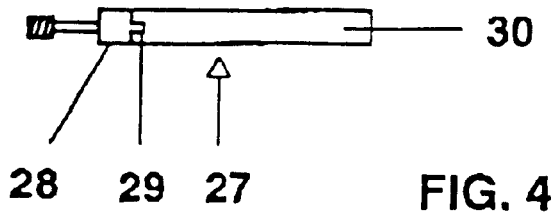

FIG. 4 shows a cermet pin 27 which is composed of two parts. The front part 28 has as its ceramic phase a garnet structure with aluminum oxide as the base material and $Er_2O_3$ as the rare-earth metal oxide. It has an axial lug 29, by means of which it is fitted into a cylindrical hole in an extension piece 30 arranged behind it. The two parts are joined together by direct sintering.

Figure 5:
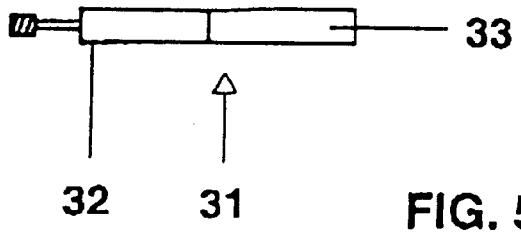

As an alternative, the two parts of the cermet pin 31, the cermets of which are weldable since the metallic phase (Mo) in both forms approx. 50% by volume, can be butt-welded to one another, as shown in FIG. 5. The front part 32 and the extension part 33 are in this case of approximately equal length. In the front part, YAG (yttrium-aluminum garnet, $3\ Y_2O_3 \cdot 5\ Al_2O_3$) is used as the ceramic phase for a 500 $\mu$m wide zone on the end side and the lateral surfaces. It has emerged that effective protection against rare-earth metals from the fill diffusing into the cermet requires a zone with a minimum thickness of 200 $\mu$m. Good results are achieved with a thickness of between 200 and 700 $\mu$m.

Figure 6:
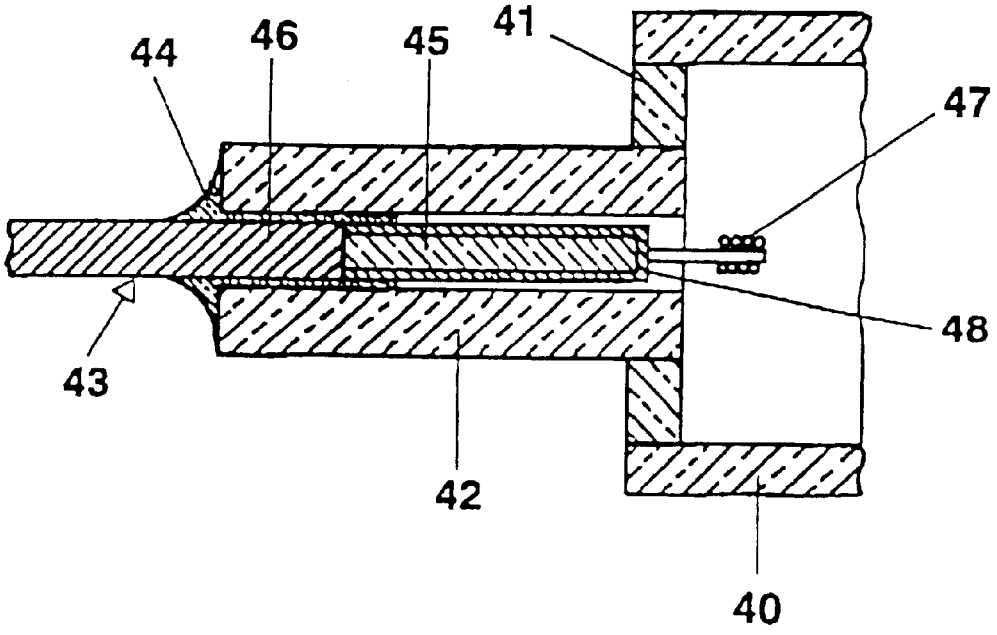

FIG. 6 shows a further exemplary embodiment, in which the end of the cylindrical ceramic discharge vessel 40 (made from aluminum oxide) is closed off by means of a ceramic end plate 41 and a tubular stopper 42. A two-part lead-through 43 is sealed in the stopper by means of soldering glass 44. The lead-through 43 comprises a discharge-side cermet pin 45 and a niobium pin 46 which is remote from the discharge. The electrode 47 is attached to the cermet pin. The surface of the cermet pin is covered by a layer 48 of YAG with a thickness of 300 $\mu$m. The conductive phase (60% by volume) of the cermet pin comprises $MoSi_2$, while the ceramic phase (remainder) comprises 50 mol % $Al_2O_3$ and 50 mol % of a mixture of YAG and $Eu_2O_3$-perovskite. As rare-earth metal iodides, the fill contains $DyI_3$ and $CeI_3$.

What is claimed is:

1. A metal halide lamp with a ceramic discharge vessel and containing a fill, said discharge vessel having two ends which are closed off by sealing means, and electrically conductive lead-throughs being guided through these means in a vacuum-tight manner, to which lead-through an electrode is attached, which electrode projects into the interior of the discharge vessel, at least a front part of the lead-through, which front part faces toward the discharge, being designed as a halide-resistant component made from electrically conductive cermet which is composed of a first electrically conductive phase and a second ceramic phase, which composes a ceramic base material, and said fill comprising at least one rare-earth metal, wherein at least at a surface of said electrically conductive cermet which is accessible to said fill, at least some of the ceramic phase comprises the combination of the ceramic base material with one or more rare-earth metal oxides.

2. The metal halide lamp as claimed in claim 1, wherein said electrically conductive cermet is in the form of a pin.

3. The metal halide lamp as claimed in claim 1, wherein the cermet contains, as the electrically conductive phase, a material selected from the group consisting of molybdenum, tungsten, rhenium or their alloys and or $MoSi_2$.

4. The metal halide lamp as claimed in claim 1, wherein the entire ceramic phase consists of the combination of the ceramic base material and one or more rare-earth metal oxides.

5. The metal halide lamp as claimed in claim 1, wherein the ceramic base material is aluminum oxide.

6. The metal halide lamp as claimed in claim 1, wherein the rare-earth metal oxides comprise the oxides of some or all of the rare-earth metals which are contained in the fill.

7. The metal halide lamp as claimed in claim 1, wherein the rare-earth metal oxides comprise the oxides of one or more rare-earth metals which are not contained in the fill, in particular $Y_2O_3$.

8. The metal halide lamp as claimed in claim 1, wherein the combination of the ceramic base material and the one or more rare-earth metal oxides corresponds to a garnet or perovskite or a mixture of the two.

9. The metal halide lamp as claimed in claim 1, wherein the rare-earth metal oxides used are predominantly or exclusively the oxides of rare-earth metals with the smallest possible ionic radius, in particular with an ionic radius which is less than or equal to the ionic radius of rare-earth metals contained in the fill.

10. The metal halide lamp as claimed in claim 1, wherein the fill contains the rare-earth metal as a halide.

11. The metal halide lamp as claimed in claim 1, wherein the sealing means (20) comprises ceramic or cermet, the ceramic base material of the cermet component (9) corresponding to a principal ceramic constituent of the sealing means.

12. The metal halide lamp as claimed in claim 1, wherein the surface is situated on the front side and, if appropriate, on the lateral surface of the cermet component.

* * * * *